United States Patent [19]

Rasmus

[11] Patent Number: 4,949,575

[45] Date of Patent: Aug. 21, 1990

[54] FORMATION VOLUMETRIC EVALUATION WHILE DRILLING

[75] Inventor: John C. Rasmus, Richmond, Tex.

[73] Assignee: Anadrill, Inc., Sugar Land, Tex.

[21] Appl. No.: 316,256

[22] Filed: Feb. 27, 1989

Related U.S. Application Data

[62] Division of Ser. No. 187,761, Apr. 29, 1988, Pat. No. 4,833,914.

[51] Int. Cl.[5] ..... E21B 49/00

[52] U.S. Cl. ..... 73/152; 166/250

[58] Field of Search ..... 73/151, 152, 151.5, 73/38; 166/250; 175/50, 39, 40

[56] References Cited

U.S. PATENT DOCUMENTS 4,064,749 12/1977 Pittman et al. ..... 73/152

4,599,904 7/1986 Fontenot ..... 73/151

*Primary Examiner*—John Chapman

*Assistant Examiner*—Kevin D. O'Shea

*Attorney, Agent, or Firm*—John J. Ryberg; Stephen L. Borst

[57] ABSTRACT

Formation Strength and other measurement while drilling parameters are combined to produce a formation volumetric analysis which may including the traditional volumetric components of clay volume, sand volume, total porosity, and water filled porosity. In shaley formations, the volumetric analysis may also include an excess or overpressure porosity. Formation Strength may be derived from measurements of torque and weight on bit and be corrected for such effects as bit dullness, mud weight and hydrostatic pressure balance.

13 Claims, 6 Drawing Sheets

FORMATION VOLUMETRIC EVALUATION WHILE DRILLING

RELATED APPLICATIONS

This application is a division of prior co-pending application Ser. No. 187,761 filed Apr. 29, 1988 now U.S. Pat. No. 4,833,914.

BACKGROUND OF THE INVENTION

It is well known that as a borehole is drilled, it is necessary to assure that the fluids found in the virgin rock or formation are not permitted to flow uncontrollably into the borehole. In extreme situations, where the formation fluid is a gas, either in its gaseous or dissolved state, incursions of the formation gas into the borehole has the effect of diluting the column of drilling mud, thereby significantly reducing bottom hole pressure and increasing the flow of formation fluids from the rock into the borehole. If this process, which tends to feed on itself, is permitted to continue, an event called a "blowout" may occur. Blowouts are undesirable not only due to the loss of the valuable formation fluids, such as hydrocarbon oil or gas, but more importantly, uncontrolled flows of formation fluids at the earth's surface is a source of pollution and, when the fluids include hydrocarbons, are likely to be ignited to produce a burning well.

As a result of this scenario, it is conventional to drill the borehole with a drilling mud whose density, mud weight, is controlled in order to assure that there is no or little chance that the formation fluids can flow into the borehole. This is accomplished by providing a drilling mud that produces a hydrostatic pressure at the bottom of the well which exceeds the pore pressure of the fluids in the rock formation. The disastrous consequences of a blowout usually cause the driller to be conservative and to specify a drilling mud weight that is calculated to guarantee that bottom hole mud pressure exceeds by quite a margin the expected formation pore pressure.

Unfortunately, there has, till now, not been available a technique for reliably determining the formation pore pressure while the borehole is being drilled. Thus the driller is likely to provide a large pressure overbalance (i.e. the difference between bottom hole mud pressure and the formation pore pressure) since the drill bit may enter an overpressured formation at any time. Drilling with a large pressure overbalance may be detrimental in that it tends to increase the "hardness" or Formation Strength of the rock thereby reducing drilling rate and, in extreme cases, it may exceed the fracture strength of the rock to thereby cause formation damage. By "Formation Strength" is meant the resistance to borehole excavation posed by the geological formation to the drill bit while the borehole is being drilled.

As sediments are buried by the deposition of materials above them, the downward pressure exerted on the materials being buried by those above cause the sediments to compress thereby reducing the pore space found between the grains of the sediment. Under normal conditions of compaction, the fluids contained in the pore space are expelled from the sediments and flow through neighboring permeable formations. In this situation, the weight of the overburden is born by the matrix of the sediments and the pore pressure is determined by the hydrostatic pressure of the fluids at that particular depth. If, however, the fluids are not permitted to flow out of the sediments that are being compressed, the pore volume, rather than decreasing, will remain essentially the same and the pressure of the fluids in the formation will provide partial support of the downward pressure exerted by the overburden. The overburden is then supported both by the rock matrix and the trapped, highly pressurized formation fluids within the pore space. Such is likely to be the situation where long columns of clay or silt sediments, which usually have a small permeability, are buried rapidly, thereby not permitting the water to escape.

With this explanation, it can be understood that fluid pressures in formations which exceed those resulting from only considerations of hydrostatics are related to an "excess porosity" as compared to those formations at the same depth which were formed in a manner which permitted the formation fluids to escape and the formation matrix to compress with a normal pore space reduction. For the purposes of this application, the excess porosity will be called overpressure porosity, phi$\phi_{op}$, and the fluid pressure in the formation will be called the pore pressure, PP. Also, for the purposes of this application, the porosity to be expected from non-exceptional formations will be called the "effective porosity", phi$_{ef}$, and the portion of the pore space filled by water will be called the "water porosity", phi$_{w}$.

Determination of a volumetric analysis of the drilled formation enables one to evaluate the formation, its hydrocarbon content, and the lithology of the formation matrix. Such volumetric analyses are important for understanding the geology and hydrology (producibility) of the well. Traditionally volumetric analyses have been performed by wireline logging tools which measure the resistivity, the natural radioactivity, the neutron porosity and the gamma density of the formation: The latter two measurements being performed primarily as investigations of the volume of pure space in the formation. It has previously been known that formations having larger values of porosity tend to drill more easily, or to have smaller Formation Strength, than formations with smaller porosities. So far as is known, no prior techniques have been proposed to utilize Formation Strength derived from drilling mechanics measurements as a porosity sensitive input on which is based a formation volumetric analysis. A technique which successfully incorporates porosity sensitive drilling mechanics measurements in a volumetric analysis has the advantage of providing the analysis while the drilling process is being performed, rather than having to wait for the time consuming process of obtaining wireline logs. Additionally, such a technique in which the radiation emitting instruments are not required clearly is advantageous, too operational and safety reasons.

SUMMARY OF THE INVENTION

A technique performing a Formation for Analysis has been developed which utilizes drilling mechanics measurements as the porosity sensitive input. The drilling mechanics measurements are embodied in a parameter called the Formation Strength. Thus, Formation Strength, formation resistivity and formation natural radioactivity are combined by way of tool response equations in the method.

It is therefore proposed to utilize this discovery in a method for investigating properties of subsurface formations traversed by a borehole while the borehole is being drilled. The method includes deriving signals indicative of formation properties from either surface or downhole measurements made while drilling. In the event that formation porosity determined from a neutron porosity tool, and formation density derived from a gamma density tool and possibly formation sonic travel time measured by a sonic logging tool are available, the additional porosity sensitive measurements may be added to the process to enable an improved product.

For each of the tools providing signals, a tool response equation is formulated to express the measured signal in terms of volumetric components, including an overpressure porosity, where appropriate. These tool response equations, in combination with an equation which states that volumes of all of the components of the formation add to equal one, are solved simultaneously by an incoherence minimization technique to produce a volumetric analysis of the formation. The volumetric analysis may provide, among other things, an excess porosity or pore volume attributable to overpressure in shales. In response to the determination of overpressure porosity, formation pore pressures and ideal drilling mud weights may be determined and the drilling process optimized.

Since the difference between borehole and pressure and pore pressure has an effect on Formation Strength, the Formation Strength tool response equation is written to take these effects into account.

DESCRIPTION OF THE PREFERRED EMBODIMENT OF THE INVENTION

Figure 1:
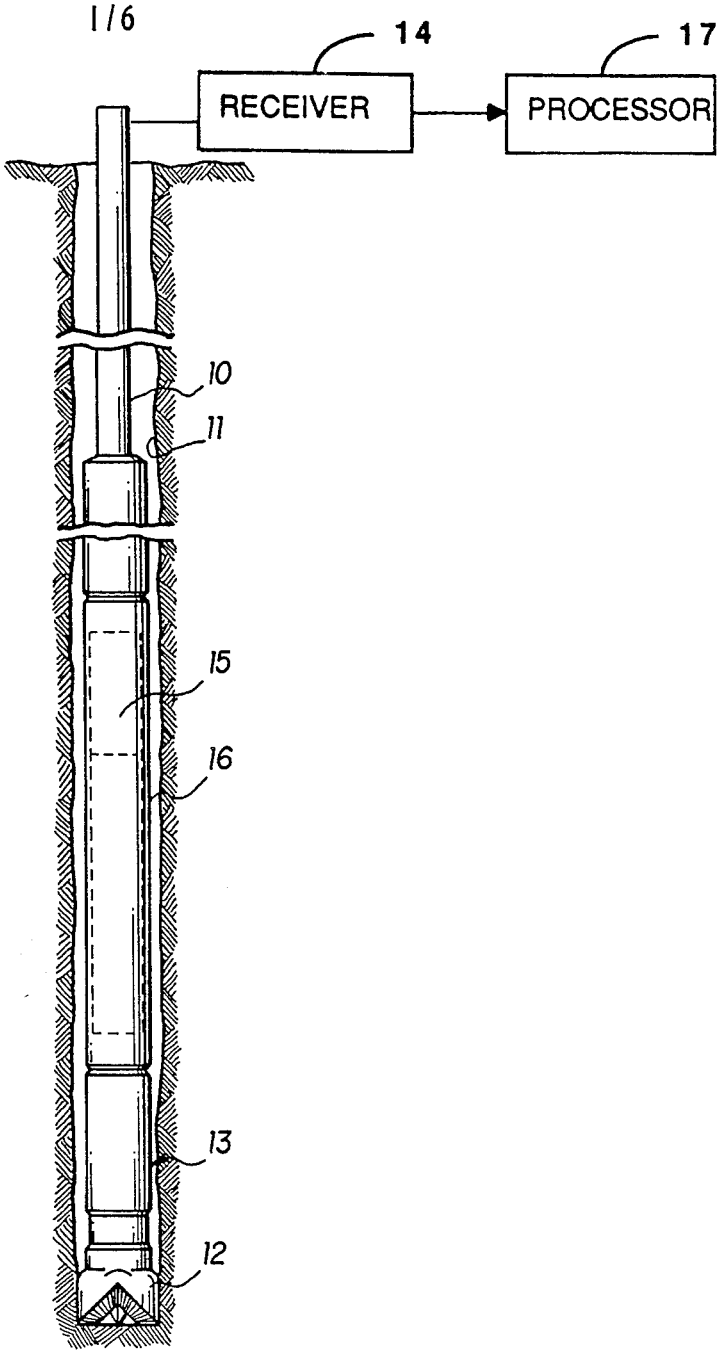
FIG. 1 is an illustration of an MWD apparatus in a drill string having a drill bit while drilling a borehole.

Referring initially to FIG. 1, there is shown a drill string 10 suspended in a borehole 11 and having a typical drill bit 12 attached to its lower end. Immediately above the bit 12 is a sensor apparatus 13 for detection of downhole weight on bit (WOB) and downhole torque (DT) constructed in accordance with the invention described in U.S. Pat. No. 4,359,898 to Tanguy et al. The output of sensor 13 is fed to a transmitter assembly 15, for example, of the type shown and described in U.S. Pat. No. 3,309,656, to Godbey. The transmitter 15 is located and attached within a special drill collar section and functions to provide in the drilling fluid being circulated downwardly within the drill string 10, an acoustic signal that is modulated in accordance with sensed data. The signal is detected at the surface by a receiving system 14 and processed by a processing means 17 to provide recordable data representative of the downhole measurements. Although an acoustic data transmission system is mentioned herein, other types of telemetry systems, of course, may be employed, provided they are capable of transmitting an intelligible signal from downhole to the surface during the drilling operation.

The drill collar may also include a section 16 which carries downhole sensors such as those useful in the determination of formation natural gamma radioactivity, GR, and formation resistivity, RES. Additionally, tool section 16 may include other formation evaluation sensors for investigating formation properties such as porosity and density derived from a neutron and a gamma ray tool respectively, and possibly a sonic tool for providing an indication of sonic travel time. Each of these additional tools in section 16 may also be coupled in the telemetry apparatus of section 15 in order that signals indicative of the measured formation properties may be telemetered to the earth's surface.

Figure 2:
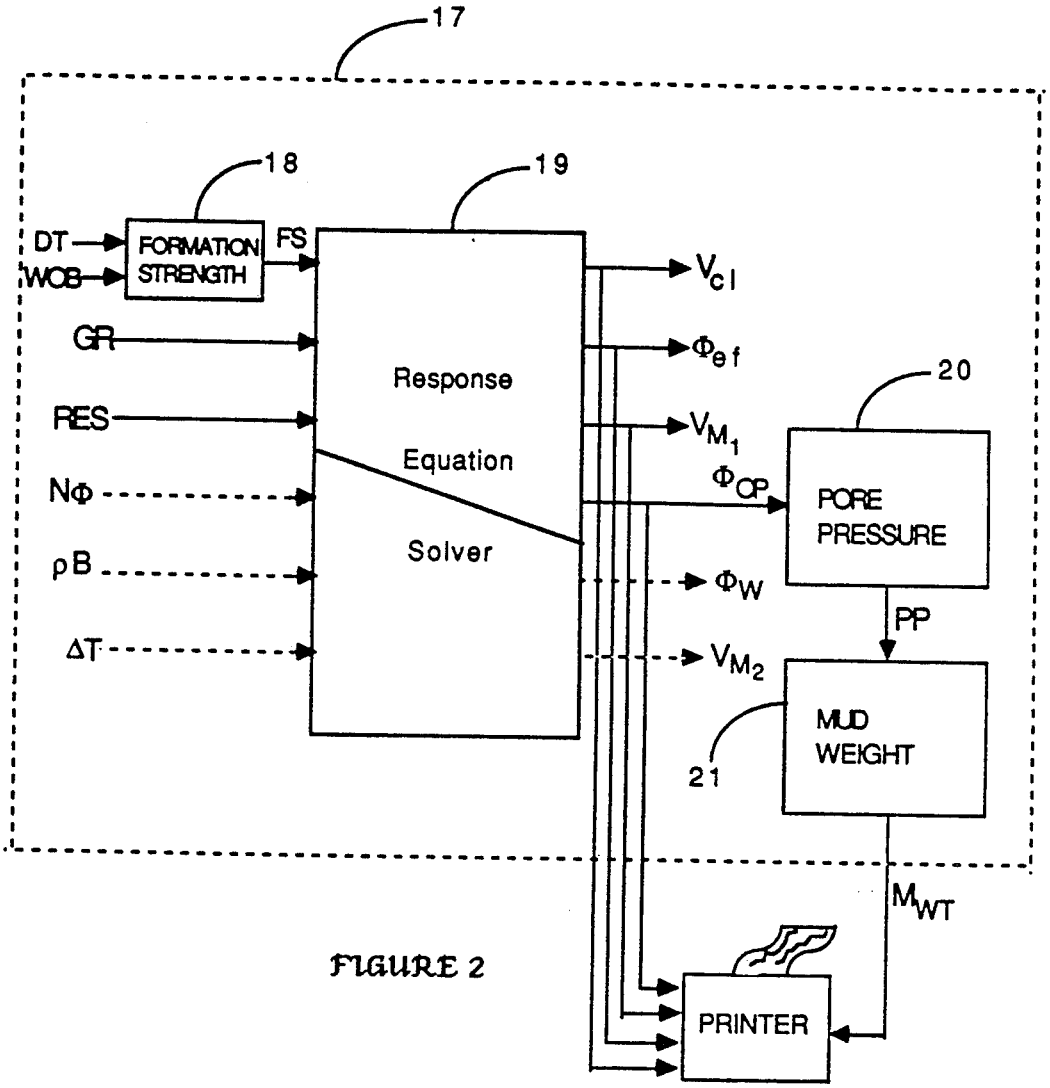
FIG. 2 is a block diagram of the interpretation functions performed on the drilling parameters generated from the apparatus of FIG. 1.

Reference is now made to FIG. 2 for a detailed representation of a preferred embodiment of the present invention. FIG. 2 illustrates the processing functions performed within the surface processing means 17. Processor 17 is a suitably programmed general purpose digital computer. The functions performed by the software programming of processor 17 are generally indicated in functional block form at 18, 19, 20 and 21. Specifically, functional block 18 represents that portion of the software of processor 17 which receives as inputs TOR and WOB (Downhole) and generates an output of Formation Strength (FS). Similarly block 19 receives FS, GR, RES, $N\phi$, $\rho B$, and $\Delta T$ as inputs and produces $V_d$, $\phi ef$, $Vm_1$, $\phi op$, $\phi w$, $Vm_2$ as outputs; block 20 receives $\phi op$ as an input and produces pore pressure (PP) as an output; while block 21 receives pore pressure (PP) as an output and generates mud weight $M_{wt}$ as its output. The procedures of each of these blocks will be described in more detail below. The downhole weight on bit (WOB) and downhole torque (DT) signals derived from real time, in situ measurements made by MWD tool sensors 13 are delivered to the processor 17. Also provided to processor 17 (not shown) are surface determined values of rotary speed (RPM), Bit Diameter (R), and Rate of Penetration (ROP). Processor 17 responds to these input signals in a manner essentially described in commonly assigned U.S. Pat. Nos. 4,627,276 and 4,685,329 (the disclosures of which are herein incorporated by reference) and as illustrated at 18, generates an indication of Formation Strength which is a function of down hole weight on bit divided by the product of bit diameter squared and dimensionless rate of penetration. Dimensionless rate of penetration in turn is the rate of penetration of the drill bit divided by the product of rate of rotation of the bit and the diameter of the bit.

Inasmuch as the Formation Strength determined from torque, weight on bit and rate of penetration is susceptible to bit wear effects, in the preferred embodiment of the present invention, the Formation Strength value is corrected for bit wear or bit efficiency ($E_d$). This is done by forming the product of the above derived Formation Strength and bit efficiency (also taught in the above referenced U.S. Pat. No. 4,627,276) to derive an indication of corrected Formation Strength. These concepts are further discussed in the February 1986 issue of *The Oil and Gas Journal* entitled "MWD Interpretation Tracks Bit Wear", which is also herein incorporated by reference. For purposes of simplicity, Formation Strength corrected for bit efficiency, hereinafter and in the drawings, will be referred to as the Formation Strength (FS).

As illustrated in FIG. 2, additional indications of the natural radioactivity (GR) and the resistivity (RES) of the formation, as well as any other parameters available, such as the neutron porosity (NPHI or Nϕ), the gamma density (RHOB or ρB) and/or the sonic travel time (delta T or ΔT) may be provided to the processor 17. The processor, illustrated by the functional block 19, then combines, at a minimum, FS, GR and RES to generate a volumetric analysis of the mineral and pore volumes present in a shaley-sand environment.

While there may be many ways to obtain a volumetric analysis from the input parameters comprising FS, GR, and RES, the technique of preference in this description is similar to that described in U.S. Pat. No. 4,338,664 (also incorporated herein by reference) which finds the best solution to a plurality of tool response equations given the tool measurements as inputs. In the wireline oilfield service industry, a volumetric analysis performed according to the teachings of the patent have come to be known as RIG (Reservoir Interpretation by Global) or DWRIG (Dual Water Reservoir Interpretation by Global) and frequently is referred to in a shorthand manner as "Global". As described in U.S. Pat. No. 4,338,664, a tool response equation is an equation which functionally relates a single tool measurement via response parameters to a chosen set of unknowns. In order to practice the "Global" technique, one must have at least as many equations as unknowns in the equations in order to find a unique solution. In this regard, a response equation is provided for each of the input measurements. Additionally, where the unknowns sought are formation volumetric components, an additional equation, the volumetric identity equation requiring the sum of all the unknown volumes to be equal to 1, may also be utilized.

Finding the best solution to several tool response equations as is performed in "Global", requires that the Response Equation Solver 19 minimizes an incoherence function given as:

$$I_{a,x} = \sum_{i=1}^{n} \frac{[a_i - f_i(x)]^2}{\sigma_i^2} + \sum_{k=1}^{n} \frac{g_k(x)^2}{\tau_k^2} \quad (1)$$

where $I_{a,x}$=the Incoherence function;

$a_i$=the measurement recorded by tool number i;

$f_i$ (x)=the tool response equation of the ith tool, (written as a function of x);

x=vector of solution;

$\sigma_i$=the uncertainty of a tool measurement;

$g_k(x)$=a constraint equation number k (written as a function of x); and $\tau_k$=the uncertainty of the constraint equation.

As mentioned, a requirement of this technique is that there must be at least as many knowns (measurements and constraints) as unknowns (volumes solved for). In the drilling environment, there may be four inputs available: RES (resistivity), GR (gamma ray), FS (Formation Strength), and the known fact that the volumes solved for must add to one. Thus four unknowns can be determined at each depth when these measurements are available. In the preferred embodiment, in a shale formation, the four unknowns which are sought are clay volume, volume of a non-clay mineral (e.g. sand), effective porosity and overpressure porosity. In a sand formation, the four unknowns which are sought are clay volume, sand volume, effective porosity and water filled porosity.

The system can also utilize the additional measurements of RHOB (bulk density), NPHI (neutron porosity), ΔT (sonic compressional travel time), and ILD (deep induction resistivity) when available from Formation Evaluation While Drilling (FEWD) or from wireline logs. When these additional logs are available, seven unknowns can be determined, but due to the tendency for redundancy between measurements (for example, RHOB, NPHI, ΔT, and FS are all strong functions of porosity) it has been found best to limit the maximum number of unknowns to six. They are:

$V_{cl}$=volume of wet clay $V_{m1}$=volume of mineral 1 (usually quartz)

$V_{m2}$=volume of mineral 2 (calcite or dolomite or anhydrite etc.)

$\phi_e$=$phi_e$=volume of effective porosity $\phi_w$=$phi_w$=volume of water in effective porosity $\phi_{op}$=$phi_{op}$=volume of effective porosity due to overpressure in shales.

Figure 3:
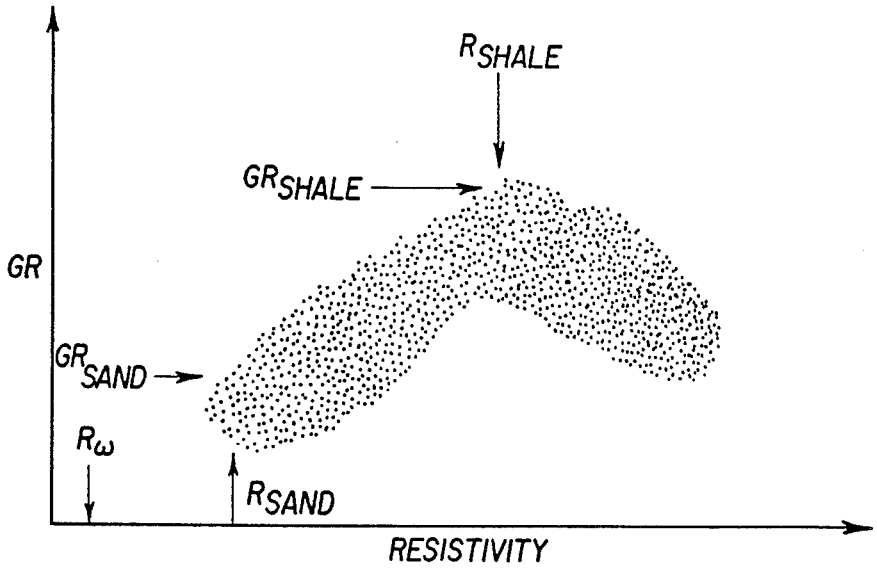
FIG. 3, is a cross plot of Gamma Ray Countrate (GR) versus formation resistivity data derived from MWD downhole tools.
Figure 4:
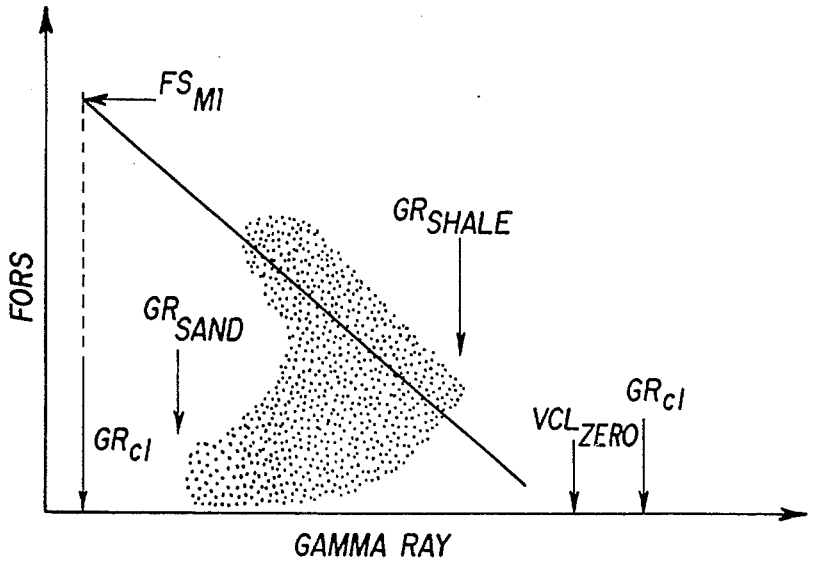
FIG. 4, is a cross plot of Formation Strength versus Gamma Ray Countrate (GR) data derived from MWD downhole tools.
Figure 5:
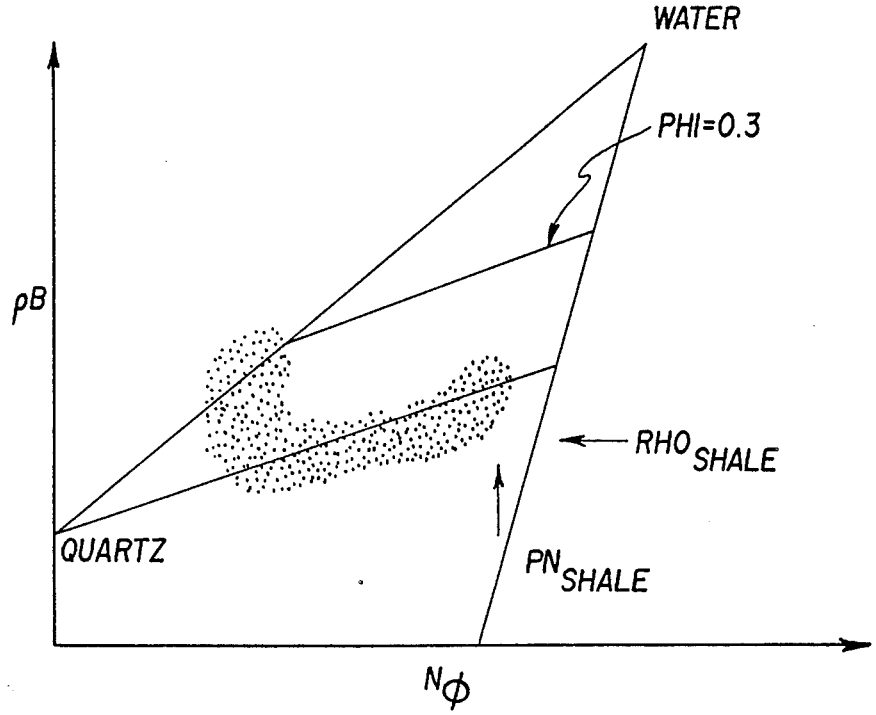
FIG. 5, is a cross plot of Formation Bulk Density (RHOB) versus Neutron porosity (NPHI) data derived from MWD downhole tools.

All the tool response equations are written (see below) as functions of the unknown volumes. The program executed in functional block 19 thus has the ability to compute theoretical logs based on the solution volumes and the equation coefficients which must be supplied to the processor 19 by the log interpreter. The equation coefficients are merely the tool response to a known mineral volume when only that mineral is present. Therefore, select coefficients appearing in the response equations below, such as $GR_{cl}$, $GR_{m1}$, $R_{cl}$, $R_w$, $FS_{m1}$, $V_{clzero}$, and $Phi_{ezero}$ may be extrapolated from data obtained from sections of the borehole where a single mineral predominates (such as clay or sandstone, for example). FIGS. 3, 4, and 5 are borehole data crossplots which are illustrative of the techniques for determining such equation coefficients.

The volumes which satisfy the set of tool response equations and the volumetric unity equation, as a group, (the minimization is a least squares fit) may or may not be the best solution for a particular individual tool response equation. If the volumes satisfy the individual tool response equations, the equations and the supplied coefficients have been well chosen and the (reconstructed) logs derived from the process will overlay the input (measured) logs. When the fit is good, the incoherence is also small. These two observations are useful for determining the quality of the calculated volumetric answers.

As described in U.S. Pat. No. 4,338,664, the technique permits one to find the unknowns by making use of all the logs available. The response equation for the Gamma Ray measurement (input in either CPS (counter per second or API units) is as follows:

$$GR = V_{cl}GR_{cl} + V_{m1}GR_{m1} + V_{m2}GR_{m2} \quad (2)$$

where

GR=the Gamma Ray measurement $V_{cl}$=volume of clay in the formation $V_{m1}$=volume of a first mineral (quartz) in the formation $V_{m2}$=volume of a second mineral (e.g. calcite or dolomite) in the formation, and $GR_{cl}$, $GR_{m1}$, and $GR_{m2}$ are the equation coefficients representative of the Gamma Ray Tool response to each respective mineral when none of the other minerals are present.

The response equation for the resistivity (RES) measurement is reciprocated into conductivity since the influence of wet clay (dry clay+bound water) and the water in the effective porosity (free water) is assumed to contribute to the measurement in a parallel manner. This allows their individual contributions to conductivity to be simply added in the following manner:

$$CSN = \frac{V_{cl}\, S_w}{R_{cl}} + \frac{S_w^2\, \phi_c^2}{a\, R_w} + \frac{\phi_{op}^2}{a\, R_{w\,op}} \quad (3)$$

where

CSN=Reciprocated resistivity measurement (RES), $R_{cl}$=resistivity of pure clay, $R_w$=resistivity of free water, $R_{w\,op}$=resistivity of water contained in the overpressure porosity, $S_w$=saturation of water in the effective porosity, and a=a formation factor constant—usually taken as 1.0.

When it is determined that the measurements are investigating overpressured shale, only the first and third terms are utilized. This is equivalent to saying that shales will not contain hydrocarbons or effective porosity and that the only contributions to conductivity will be the wet clay and the porosity created by overpressure.

When the program executed in functional block 19 determines that its measurements are investigating porous, non shaly formations, only the first and second terms are utilized. The effective porosity calculated by the program is then defined as that porosity which contains free water or moveable water in a sand environment. The sands are considered to be at the same pressure as the shale immediately above them. The effective porosity in this environment is not distinguishable from the overpressure porosity so no estimate of pressure is available in porous formations.

Formation Strength may be derived at 19 from a variety of parameters, some of which are measurements made by an MWD tool during the drilling process, as follows:

$$FS = \frac{WOB\ \mathrm{RPM}\ 40\, A_1\, E_d}{ROPBDIAM} \quad (4)$$

where

WOB=weight on bit (KLBS)

RPM=revolutions per minute,

A=a gouging component of bit torque derived from a Dimensionless torque/Dimensionless Rate of Penetration crossplot, $E_d$=efficiency of bit based on tooth wear and WOB, ROP=rate of penetration (FT per HR), and BDIAM=bit diameter in inches.

The Formation Strength response equation is as follows:

$$FS = FS_{ma} - FS_{ma}\frac{V_{cl}}{V_{cl\,zero}} - FS_{ma}\frac{\phi_c}{\phi_e\ \mathrm{zero}} - FS_{ma}\frac{\phi_{op}}{\phi_{e\,zero}} \quad (5)$$

where $FS_{ma}$32 Formation Strength of the non-clay mineral, $V_{clzero}$=extrapolated volume of clay where the $FS_{meas}$ equals zero, $\phi$ezero=phi$_{ezero}$=extrapolated porosity where the $FS_{meas}$ equals zero.

This equation states that both porosity and clay decrease the Formation Strength of the rock. Thus even though a sandstone formation may have less clay than the shales, it still drills more easily because of the greater influence of porosity on the Formation Strength.

When it is determined by the program that the measurements are investigating overpressured shale, only the first, second and fourth terms are utilized in block 19. On the other hand, when it is determined that the measurements are investigating a porous non-shaly formation, the first, second, and third terms are utilized and any increase in porosity due to overpressure is included in the effective porosity. It is of note that water filled pososity does not appear in the FS response equation.

In the above Formation Strength response equation, the influence of the difference between bottom hole drilling mud hydrostatic pressure and formation pore pressure on the formation's strength has not been included. This pressure difference does, however, have an effect on Formation Strength and should therefore be taken into account. Additionally, the drilling mud weight is found to have an effect on the Formation Strength so that mud weight must also be taken into account. In order to obtain an indication of Formation Strength that is independent of the pressure difference and mud weight effects for use in the Formation Strength tool response equation, the following equation (which converts the measured Formation Strength into a nominal Formation Strength for nine pound per gallon drilling mud and zero pressure difference) is utilized:

$$FS = FS_{9\,ppg,0\,\delta P}\left[1.75\frac{MWT}{9.0} - 0.75\right][0.002\,(P_{mud} - P_{w\,pore}) + 1.0] \quad (6)$$

where

FS=Formation strength measured by the MWD tool, $F_{9ppg,\,o\delta P}$=apparent Formation Strength at 9 pounds per gallon mud and 0 differential pressure, $P_{mud}-P_{wpore}$=differential pressure, and MWT=the actual mud weight (lbs/gal).

In addition to the above response equations, the volumetric identity equation which requires that the sums of the volumes of the various formation components must equal unity is used at 19 and is as follows:

$$1.0 = V_{cl} + V_{m1} + V_{m2} + \phi_c + \phi_{op}, \quad (7)$$

Clearly $V_{m1}$ and $V_{m2}$ can be treated as a single variable where there are only three response equations, but can appear as separate variables where there are more than three response equations.

As mentioned earlier, the traditional wireline type measurements of RHOB, NPHI, and $\Delta T$ may also be utilized with their respective tool response equations which may be simplified versions of the GLOBAL equations disclosed in U.S. Pat. No. 4,338,664. For example, the following neutron porosity response equation may be utilized where neutron porosity logs from either MWD or wireline investigations are available:

$$NPHI = PN_{mf}Phi_{mf} + PN_{cl}V_{cl} + PN_{m1}V_{m1} + PN_{hy}\text{-}Phi_{hy} \quad (8)$$

where $PN_{mf}$, $PN_{c1}$, $PN_{m1}$ and $PN_{hy}$ are parameters determined to be equal to the measurements expected to be made by the neutron porosity tool completely surrounded by drilling mud filtrate, clay, a first mineral (quartz, for example), and hydrocarbon respectively;

$Phi_{mf}$=the pore space occupied by the drilling fluid filtrate which is equal to the water saturation $S_w$ times the effective porosity ($phi_e$) of the formation;

$Phi_{hy}$=the pore space occupied by the hydrocarbon in the formation and is equal to one minus the water saturation ($S_w$) times the effective porosity ($Phi_e$);

$V_{cl}$=the Volume of the formation which is a clay mineral; and $V_{m1}$=the Volume of the formation which is a non-clay mineral (eg. quartz).

Also, the following gamma density response equation may be used where a gamma density log is available:

$$RHOB = RHO_{mf}Phi_{mf}'RHO_{c1}V_{cl} + RHO_{m1}V_{m1} + \text{-}RHO_{hy}Phi_{hy} \quad (9)$$

where $RHO_{mf}$, $RHO_{ce}$, $RHO_{m1}$ and $RHO_{hy}$ are parameters determined to be equal to the measurements expected to be made by the gamma density tool completely surrounded by drilling fluid filtrate, clay, a non-clay mineral, and hydrocarbon respectively.

The addition of these measurements allows the computation of an additional mineral $V_{m2}$, and adds stability to the computation since it is mathematically overdetermined.

As is pointed out in Patent No. 4,338,664, the computation of the unknown volumes may be improved if there are additional constraints imposed on the variables. For example, it is known that the mineral volumes (clay and quartz) and porosity lie between two bounds such as 0 and 1. When this constraint is violated the incoherence increases which causes the minimization to bring the individual volume back in bounds. A continuity constraint which inhibits wild fluctuations in the answer from one depth frame to another may also be implemented to further improve the computed results.

Figure 6:
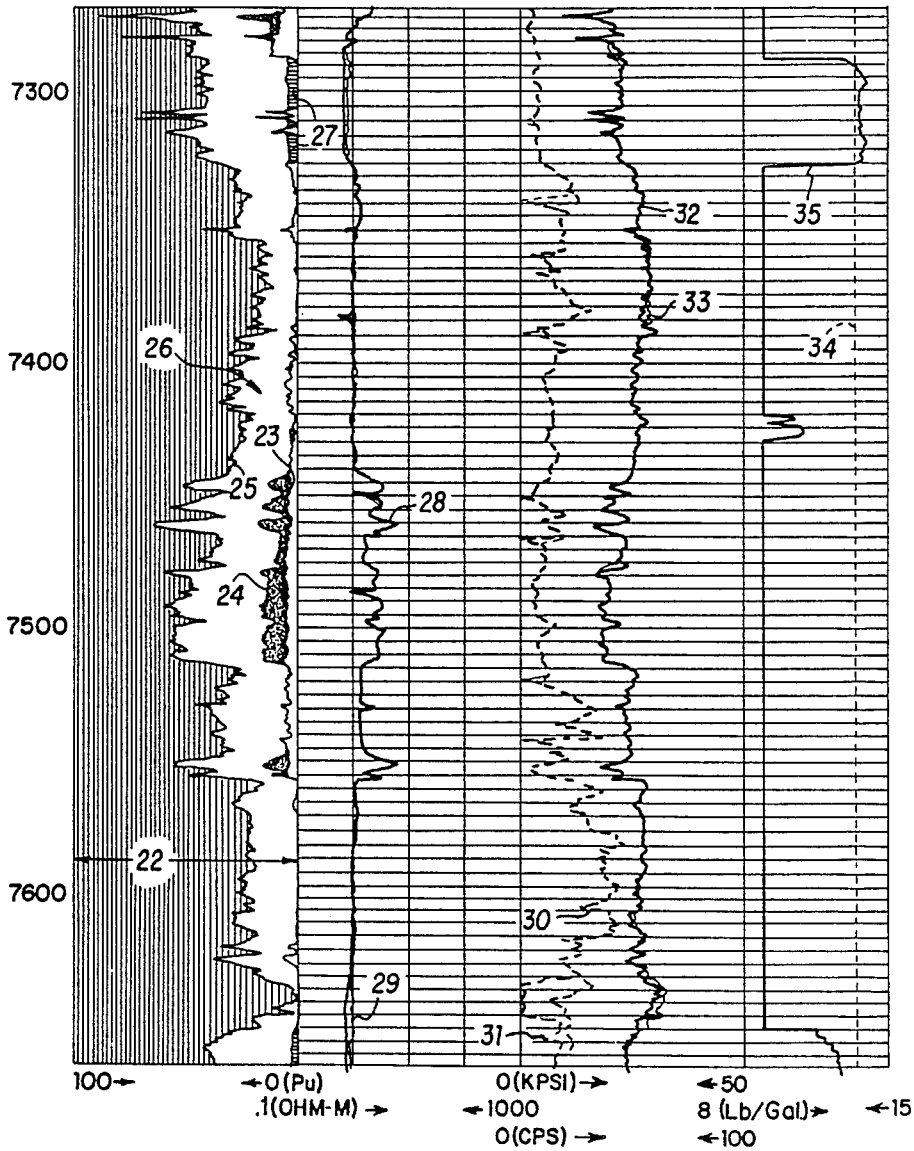
FIG. 6 is an example of a volumetric analysis log in a shale and a shaley sand zone produced using the principles of the present invention and showing the mud weight compared to the calculated pore pressure expressed in mud weight units.

Once the series of simultaneous response equations have been solved by the solver 19 of the processor 17 illustrated in FIG. 2, the volumetric outputs $V_{cl}$, $Phi_{ef}$, $V_{m1}$, and $Phi_{op}$ are generated as outputs and may be plotted as a volumetric analysis log, an example of which is shown in FIG. 6. As previously mentioned, $Phi_{op}$ is then utilized by additional calculations in processor 17 to derive a value of pore pressure (PP) at functional block 20. The following relationship has been found to be effective in the Gulf of Mexico for deriving pore pressure from $Phi_{op}$:

$$\text{Log}\left(1.0 + \frac{\phi_{op}}{\phi_{nor}}\right) = \frac{\alpha_{uncb}}{\gamma\ eff_{nor}}\left[P_{w\ pore} - \frac{\alpha_{nor}}{\alpha_{unc}}(P_{w\ nor})\right] \quad (10)$$

where $Phi_{op}$=the overpressure porosity from solver 19, $Phi_{nor}$=the effective porosity of a normally pressured shale, $\alpha_{unc}$=the Biot constant for overpressured shales, $\alpha_{nor}$=The Biot constant for normally pressured shales, b=a constant $\gamma eff_{nor}$=the effective stress gradient to be provided by the log analyst in accordance with the local geology, $P_{w\ pore}$=PP=pressure of pore water in overpressured shale $P_{w\ nor}$=normal hydrostatic pore pressure.

It has been found that the following assumptions may be made for Gulf of Mexico geologies:

$Phi_{nor}=0.10$ $\alpha_{unc}=1.0$ $\alpha_{nor}=1.0$ $b=2.675*10^{-5}$.

A pore pressure computation is not performed by the program at 20 in sand zones since the porosity due to overpressure cannot be distinguished from the effective porosity. However, when in a sand, the volumetric analysis provides volumes of shale, sand, effective porosity, and water filled porosity. As is known, the difference between the effective porosity and the water filled porosity is the hydrocarbon saturation, so that the technique may be utilized to identify hydrocarbon bearing beds. When this identification is made, the driller may suspend the drilling operation to perform further testing of the identified zone such as withdrawing fluids from and analyzing the pressures of the hydrocarbon bearing zone with an RFT (repeat formation tester) or with a drill stem test or a side wall core may be extracted from the zone of interest.

Having obtained the pore pressure from the above relationship executed in processor 17 by the program illustrated by block 20, information from the processor 17 may then be used to influence the drilling process. For example, where the pore pressure exceeds the bottomhole pressure due to the drilling mud in the borehole, it may be expected that the formation fluids will flow into the borehole: an event that should be avoided. Thus, on observing this, the driller would take corrective actions such as shutting in the well or increasing the mud weight. When used properly, the driller will never permit the drilling mud pressure to fall below the formation pore pressure. Rather, he will establish a safety margin and vary the mud weight to maintain that margin. When the driller gains confidence in this process, the safety margin may be reduced to minimize the mud weight and thereby the bottom hole pressure which has the effect of minimizing the ability of the formation to resist the drilling process and of maximizing the rate of penetration, thus allowing the well to be drilled in the least amount of time without risking blowout.

In a preferred embodiment, therefore, processor 17 may respond to the pore pressure indication (illustrated by functional block 21) from functional block 20 and convert the calculated pore pressure to an equivalent mud weight $M_{wt}$ by dividing the pore pressure by 0.052 times the true vertical depth. This produces the pore pressure in units of pounds per gallon. The pore pressure so expressed is then plotted on a log alongside of a trace of the mud weight as illustrated in FIG. 6 so that the driller may compare the actual mud weight with the pore pressure expressed as a mud weight thereby enabling him to evaluate and maintain a margin of safety.

Turning now to FIG. 6, there is illustrated a typical graphical output or log of the information derived from the invention. Numeral 22 appearing at the bottom left of the figure generally indicates that section of the log which presents a volumetric interpretation of the formation in 0 to 100 porosity units (PU). Contained within the volumetric analysis are a trace 23 indicative of the water filled pore space, a trace 24 indicative of the effective pore space, a trace 27 indicative of the overpressure porosity, a trace 25 indicative of a first mineral component (in this example, quartz or sandstone), and a residual area 26 indicative of a second mineral (in this example, shale). As will be understood, the difference between the effective porosity 24 and the water filled porosity 23 is normally attributable to a hydrocarbon such as oil or gas.

In the track adjacent to the volumetric analysis appear a pair of resistivity logs with units of ohm meters: 28 representing the actual resistivity measurements and 29 representing the value of resistivity reconstructed from the "Global" type of incoherence minimization analysis. Due to the nature of the analysis, the magnitude of the difference between the two resistivity logs is an indication of the reliability of the information. Looking further to the right in FIG. 6 there appears Formation Strength (measured) 30 and Formation Strength (reconstructed) 31 on a scale of 0 to 50 KPSI and Gamma Ray (measured) 32 and Gamma Ray (reconstructed) 33 on a scale of 0 to 100 counts per second (CPS).

Finally, in the right-most track there appears a trace indicative of the actual mud weight 34 in pounds per gallon (lbs/gal) and an indication of the recommended mud weight needed to balance out the formation pore pressure/borehole pressure imbalance created by an overpressured formation. At a depth beginning slightly under 7300 feet, there can be seen an imbalance corresponding to an overpressure porosity that can be corrected by increasing the mud weight in the borehole from about 13 lbs/gal to about 14 lbs/gal. While 13 lbs/gal would be an appropriate mud weight above this zone, once such a zone is encountered, it would be desirable for the driller to increase the weight of the drilling mud in the borehole to at least 14 lbs/gal in order to be sure that formation fluids are prevented from flowing into the borehole.

What is claimed is:

1. A method for investigating properties of subsurface formations traversed by a borehole, the method comprising the steps of:

a. deriving a drilling signal indicative of the resistance of the formation to being drilled by a drill bit;

b. deriving a plurality of additional signals indicative of formation properties; and b. in response to said drilling signal and to said additional signals, deriving a volumetric analysis of the subsurface formation.

2. The method as recited in claim 1 wherein said volumetric analysis of the subsurface formation includes a clay volume, a non-clay mineral volume, and a porosity.

3. The method as recited in claim 1 wherein said additional signals include formation resistivity and formation natural gamma ray radioactivity.

4. The method as recited in claim 1 wherein said drilling signal includes Formation Strength.

5. The method as recited in claim 4 wherein said Formation Strength has been corrected for the effects of bit wear.

6. The method as recited in claim 1 wherein said step of deriving said drilling signal includes the steps of deriving a signal indicative of the weight applied to the bit and of deriving a signal indicative of the torque at the bit.

7. The method as recited in claim 1 wherein said step of deriving a volumetric analysis includes the step of determining a plurality of tool response equations which each relate a derivable formation property to a plurality of unknown formation properties selected from the group comprising: clay volume, volume of a non-clay mineral, and pore volume.

8. The method as recited in claim 7 wherin one of said response equations comprises the following relationship:

$$FS = FS_{ma} - FS_{ma}\frac{V_{cl}}{V_{clzero}} - FS_{ma}\frac{\phi_e}{\phi_{ezero}} - FS_{ma}\frac{\phi_{op}}{\phi_{ezero}}$$

where

FS = measured Formation Strength $FS_{ma}$ = Formation Strength of mineral of volume = 1

$V_{cl}$ = clay volume $V_{clzero}$ = clay volume when FS = 0

$\phi_{ezero}$ = extrapolated porosity where FS = 0.

9. The method as recited in claim 6 wherein said drilling signal is Formation Strength derived from measurements of downhole bit torque and downhole weight on bit.

10. The method as recited in claim 7 wherein said derivable properties include properties selected from the group comprising Formation Strength, resistivity, natural radioactivity, neutron porosity, gamma ray density, sonic travel-time, and deep induction resistivity.

11. The method as recited in claim 9 wherein Formation Strength is derived as a function of downhole weight on bit, rate of bit rotation, bit efficiency, gouging component of bit torque, rate of penetration and bit diameter.

12. The method as recited in claim 7 in which one of the response equations is the Formation Strength response equation which is a function of drilling mud weight.

13. The method as recited in claim 7 in which one of the response equations is the Formation Strength response equation which is a function of the difference between formation pressure and the drilling fluid pressure at the location of the bit.

* * * * *